US009278742B2

(12) United States Patent
Young

(10) Patent No.: US 9,278,742 B2
(45) Date of Patent: Mar. 8, 2016

(54) REBREATHER MOUTHPIECE

(75) Inventor: James Michael Young, Fort Smith, AR (US)

(73) Assignee: KISS Rebreather, LLC, Fort Smith, AR (US)

( * ) Notice: Subject to any disclaimer, the term of this patent is extended or adjusted under 35 U.S.C. 154(b) by 344 days.

(21) Appl. No.: 13/823,238

(22) PCT Filed: Oct. 7, 2011

(86) PCT No.: PCT/CA2011/050632

§ 371 (c)(1),
(2), (4) Date: Mar. 14, 2013

(87) PCT Pub. No.: WO2012/045178

PCT Pub. Date: Apr. 12, 2012

(65) Prior Publication Data

US 2013/0186402 A1 Jul. 25, 2013

Related U.S. Application Data

(60) Provisional application No. 61/390,928, filed on Oct. 7, 2010.

(51) Int. Cl.
*B63C 11/24* (2006.01)
*A62B 9/06* (2006.01)
(Continued)

(52) U.S. Cl.
CPC . *B63C 11/24* (2013.01); *A62B 9/06* (2013.01); *B63C 11/186* (2013.01); *B63C 11/22* (2013.01)

(58) Field of Classification Search
CPC ..... A61M 16/0045; A62B 9/06; B63C 11/14; B63C 11/18; B63C 11/186; B63C 11/24; Y10S 128/914; F16K 31/084
USPC ..... 128/200.29, 201.27, 201.28, 204.19, 128/205.12, 205.17, 205.24, 914; 251/65; 137/625.48
See application file for complete search history.

(56) References Cited

U.S. PATENT DOCUMENTS 2,651,051 A * 9/1953 Parks ..... E03B 1/04 137/625.44
2,667,895 A * 2/1954 Pool ..... F16K 15/06 137/528

(Continued)

FOREIGN PATENT DOCUMENTS

WO WO2007/126317 A1 11/2007
WO WO2009/058080 A1 5/2009

OTHER PUBLICATIONS

Walden, Linda Lee, "Learning the Scuba Language: A Dictionary for New Divers", retrieved from http://web.archive.org/web/20071014030320/http://www.dtmag.com/Stories/What%20About/01-06-feature.htm—Oct. 14, 2007.*

(Continued)

*Primary Examiner* — Tan-Uyen (Jackie) T Ho
*Assistant Examiner* — Joseph D Boecker
(74) *Attorney, Agent, or Firm* — Kilpatrick Townsend & Stockton LLP

(57) ABSTRACT

A mouthpiece for a rebreather has a tubular housing having opposed inhale and exhale ends, a mouth port, and a discharge port. Supported for movement within a bore of the housing is a valve assembly which is magnetically biased toward a valve-closed position preventing air in an air space of the bore from moving to the exhale end and the discharge port. As a diver exhales into the mouth port, the increase in air pressure of the air space causes the valve assembly to assume a valve-open position, exposing a transverse channel extending between the air space and the discharge port, and a recirculation air channel extending between the air space and the exhale end. A portion of the exhaled air is exhausted to the ambient environment through the discharge port, while the remainder exits the mouthpiece at the exhale end for recirculation through the rebreather.

33 Claims, 3 Drawing Sheets

(51) Int. Cl.
*B63C 11/18* (2006.01)
*B63C 11/22* (2006.01)

(56) References Cited

U.S. PATENT DOCUMENTS

| | | | | | |
|---|---|---|---|---|---|
| 2,788,019 | A * | 4/1957 | Mottram | F16K 15/18 | 137/625.48 |
| 3,669,109 | A | 6/1972 | Cheffers et al. | | |
| 3,695,293 | A * | 10/1972 | Zeuner | F16K 11/10 | 137/625.48 |
| 3,721,238 | A * | 3/1973 | Wise | A61M 16/104 | 128/205.24 |
| 3,726,274 | A * | 4/1973 | Bird | A61M 16/00 | 128/205.24 |
| 4,022,201 | A * | 5/1977 | Diggs | B63C 11/24 | 128/201.11 |
| 4,683,914 | A * | 8/1987 | Brisland | F01L 15/08 | 137/625.25 |
| 4,809,691 | A | 3/1989 | Paole et al. | | |
| 4,938,211 | A | 7/1990 | Takahashi et al. | | |
| 5,036,841 | A * | 8/1991 | Hamilton | A62B 7/10 | 128/202.26 |
| 5,127,398 | A * | 7/1992 | Stone | A62B 9/02 | 128/204.18 |
| 5,368,018 | A | 11/1994 | Stone | | |
| 5,429,124 | A | 7/1995 | Yoshida et al. | | |
| 5,619,987 | A * | 4/1997 | Matsuoka | A62B 7/04 | 128/204.26 |
| 5,690,099 | A * | 11/1997 | Abramov | A62B 19/02 | 128/202.26 |
| 5,720,279 | A | 2/1998 | Furuichi et al. | | |
| 5,724,961 | A | 3/1998 | Tistrand | | |
| 5,971,021 | A * | 10/1999 | Graham | B60T 7/206 | 137/625.48 |
| 6,796,307 | B1 * | 9/2004 | Hughson | A62B 7/14 | 128/204.28 |
| 7,089,939 | B2 * | 8/2006 | Walker | A61M 16/06 | 128/205.24 |
| 2006/0266359 | A1 | 11/2006 | Van Beurden et al. | | |
| 2008/0216836 | A1 | 9/2008 | Ottestad | | |
| 2009/0320847 | A1 * | 12/2009 | Bozanic | A62B 9/022 | 128/205.24 |
| 2010/0043797 | A1 * | 2/2010 | Deas | A62B 9/02 | 128/205.24 |
| 2011/0073111 | A1 * | 3/2011 | Stone | B63C 11/186 | 128/205.24 |

OTHER PUBLICATIONS

Tagliati, Michel, "The Long (his)Story About Scrubbers & Sensors: From Fleuss to Evolution"; X-Ray Mag: 4: 2005, p. 82-87; retrieved from http://www.xray-mag.com/pdfs/articles/Tech_Rebreather_Intro_04.pdf.*

International Search Report and Written Opinion of PCT/CA2011/050632 mailed on Jan. 3, 2012, 9 pages.

Webpage titled BMD SCR4: <www.therebreathersite.nl/10_Semiclosedrebreathers/bmd_scr4.htm>.

* cited by examiner

REBREATHER MOUTHPIECE

RELATED APPLICATIONS

This application claims the benefit of the priority of U.S. application No. 61/390,928 filed 7 Oct. 2010 and entitled REBREATHER MOUTHPIECE which is hereby incorporated herein by reference. For the purpose of the United States this application claims the benefit of the provisions of 35 USC §119(e) with respect to U.S. application No. 61/390,928.

TECHNICAL FIELD

This invention relates to rebreathers. Embodiments of the invention relate to a mouthpiece for rebreather systems. Embodiments of the invention have particular application to semi-closed circuit scuba diving rebreather systems.

BACKGROUND

Scuba diving breathing systems include open-circuit and rebreather systems. In open-circuit systems, all of the diver's exhaled air is exhausted to the ambient environment (e.g. typically, into the surrounding water). In rebreather systems, at least a portion of the diver's exhaled air is recaptured and is recycled through a breathing loop which typically includes an expandable/contractible counterlung and a carbon dioxide scrubber. Rebreather systems include one or more gas supplies, containing gas such as pure oxygen, a mixture of oxygen, nitrogen and/or helium (e.g. trimix or nitrox) and/or the like. Gas from the one or more gas supplies is injected into the breathing loop to replenish the air consumed and/or exhaled by the diver.

Rebreather systems may be provided as closed-circuit or semi-closed circuit systems. In closed-circuit systems, all of the diver's exhaled air is recaptured and recycled through the breathing loop. Closed-circuit systems typically supply a combination of pure oxygen and a diluent gas (e.g. air or trimix) to the breathing loop, and include oxygen monitoring systems to monitor and adjust oxygen levels to guard against oxygen toxicity. In semi-closed circuit systems, a portion of the diver's exhaled air is exhausted from the rebreather loop to the ambient environment (typically from a port in the breathing loop located on the diver's back) and the remainder is recaptured and recycled through the breathing loop. Semi-closed circuit systems typically supply gas mixtures (e.g. nitrox) to the breathing loop and do not require oxygen monitoring systems. Semi-closed circuit systems tend to involve fewer components and are generally lighter, more compact, and easier and safer to use and maintain than closed-circuit systems.

In rebreather systems, a diver exhales and inhales through a mouthpiece which directs an incoming supply of air from the breathing loop to the diver's mouth, and directs outgoing or exhaled air from the diver's mouth toward the breathing loop for recirculation through the breathing loop. In semi-closed circuit rebreather systems, a portion of the exhaled air is discharged or exhausted to the ambient environment, typically at an outlet in the breathing loop and away from the mouthpiece.

There is a need for a mouthpiece which may be used with semi-closed circuit rebreather systems. There is a need for a mouthpiece which exhausts a portion of the exhaled air to the ambient environment while directing the remainder of the exhaled air to the breathing loop.

SUMMARY

One aspect of the invention provides a mouthpiece for a rebreather having a breathing loop. The mouthpiece includes a tubular housing having longitudinally opposed inhale and exhale ends. The inhale end is in fluid communication with an egress of a breathing loop and the exhale end is in fluid communication with an ingress of the breathing loop.

The mouthpiece has a mouth port through which a user inhales and exhales. The mouth port leads to a bore of the housing. The mouthpiece also has discharge and recirculation air channels having openings into the bore. The discharge air channel extends transversely through a body of the housing and leads to a discharge port in fluid communication with the ambient environment. The recirculation air channel extends longitudinally through the body of the housing and leads to the exhale end.

A moveable valve component is supported for movement in longitudinal directions within the bore and is shaped to define a portion of an air space within the bore between the moveable valve component and the inhale end. The moveable valve component is biased toward a valve-closed position in which the moveable valve component: is spaced apart from the exhale end by a valve closed distance $d_{max}$; and is located to block air flow into the openings of the discharge and recirculation air channels. An increase of air pressure in the air space tends to counteract the bias and move the moveable valve component toward a valve-open position in which the distance between the moveable valve component and the exhale end is less than the valve closed distance $d_{max}$ and the openings of the discharge and recirculation air channels are exposed to permit air flow therethrough. The distance by which the moveable valve component moves toward the exhale end determines a length of the openings of the discharge and recirculation air channels exposed to permit air flow therethrough. The increase in air pressure is caused by the user exhaling through the mouth port and thereby introducing air into the air space.

The movement of the moveable valve component to the valve-open position causes an increase in the size of the air space and a corresponding reduction in air pressure. The valve-open position represents an equilibrium between forces caused by the air pressure and the bias.

The moveable valve component may be magnetically biased toward the valve-closed position. A first magnet may be disposed within the moveable valve component and a second magnet may be disposed at the exhale end. The first and second magnets are arranged with like poles facing each other.

The discharge air channel has a first width and the recirculation air channel has a second width which is larger than the first width. In particular embodiments, a number of discharge air channels, a number of recirculation air channels and the first and second widths are selected such that between approximately 20% to 30% of the exhaled air travels through the discharge air channel to the discharge port while the remainder of the exhaled air travels through the recirculation air channel to the exhale end.

In addition to the exemplary aspects and embodiments described above, further aspects and embodiments will become apparent by reference to the drawings and by study of the following detailed descriptions.

BRIEF DESCRIPTION OF DRAWINGS

Exemplary embodiments are illustrated in referenced figures of the drawings. It is intended that the embodiments and figures disclosed herein are to be considered illustrative rather than restrictive. In drawings which depict non-limiting embodiments of the invention.

DESCRIPTION

Throughout the following description, specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Particular embodiments provide a mouthpiece for semi-closed circuit rebreather systems which may be used in scuba diving applications and/or for other applications suitable for semi-closed circuit rebreather systems. The mouthpiece includes a valve assembly for controlling the flow of air through the mouthpiece. The valve assembly is operable to direct some of the diver's exhaled air to the ambient environment (i.e. surrounding water) through a discharge port in the mouthpiece. The valve assembly is operable to direct the remainder of the diver's exhaled air to the breathing loop for recirculation through the breathing loop. Operation of the valve assembly is controlled by the diver's breathing.

Figure 1A:
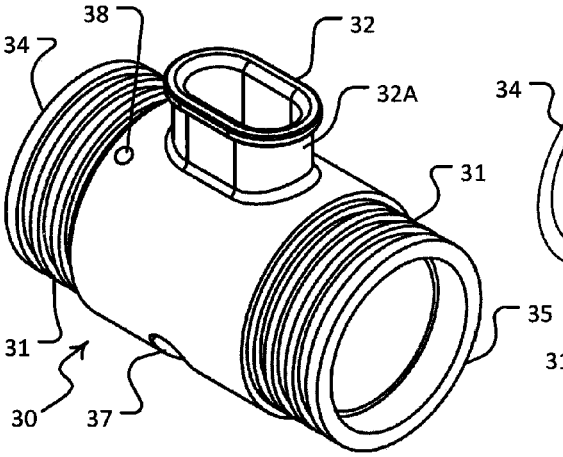
FIGS. 1A and 1B are isometric views of an outer casing of a mouthpiece according to one embodiment.
Figure 1B:
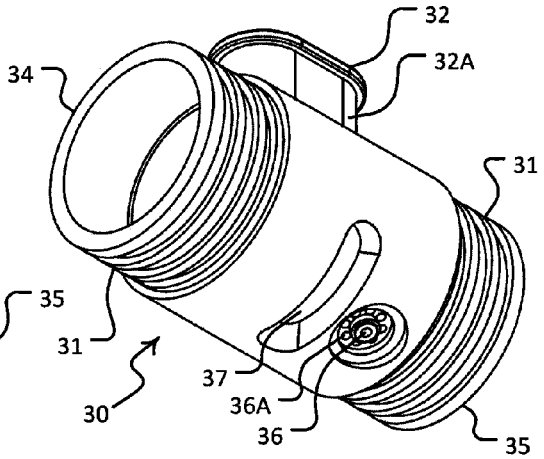
Figure 1C:
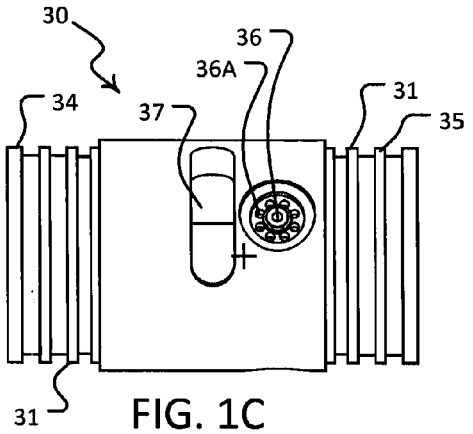
FIGS. 1C through 1E are side elevation views of the casing shown in FIGS. 1A and 1B.
Figure 1D:
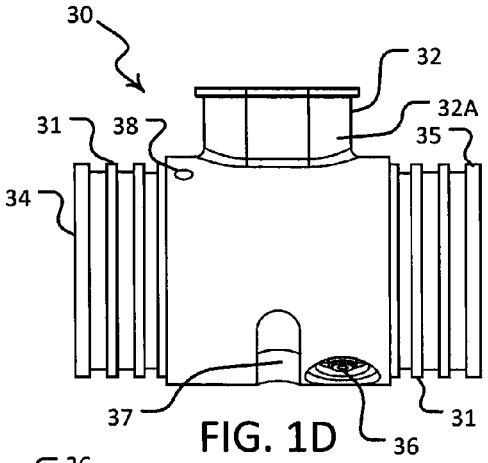
Figure 1E:
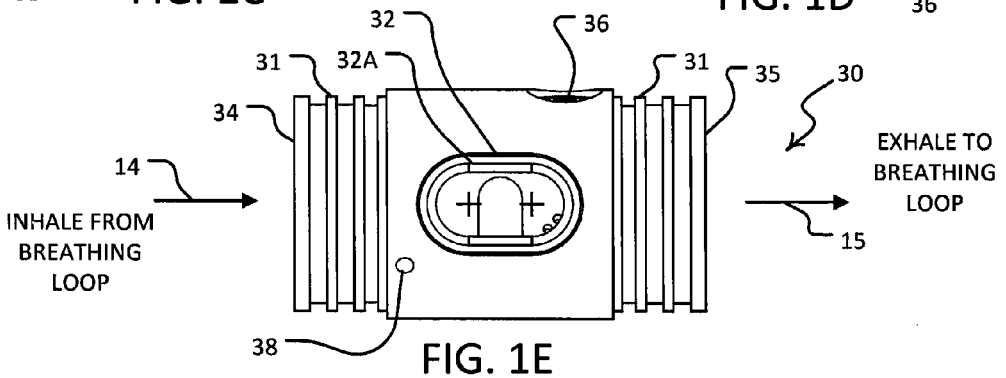
Figure 2A:
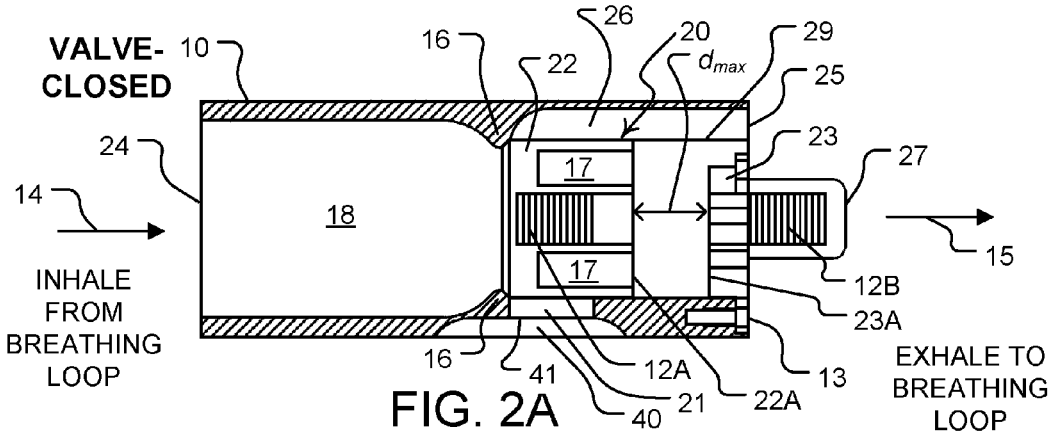
FIGS. 2A and 2B are cross-sectional views of a sleeve and a valve assembly of a mouthpiece according to one embodiment which may be housed within the casing shown in FIGS. 1A through 1E. The cross-sectional views of FIGS. 2A and 2B are taken along line A-A of FIG. 2C, and illustrate the valve in a closed position and an open position, respectively.
Figure 2B:
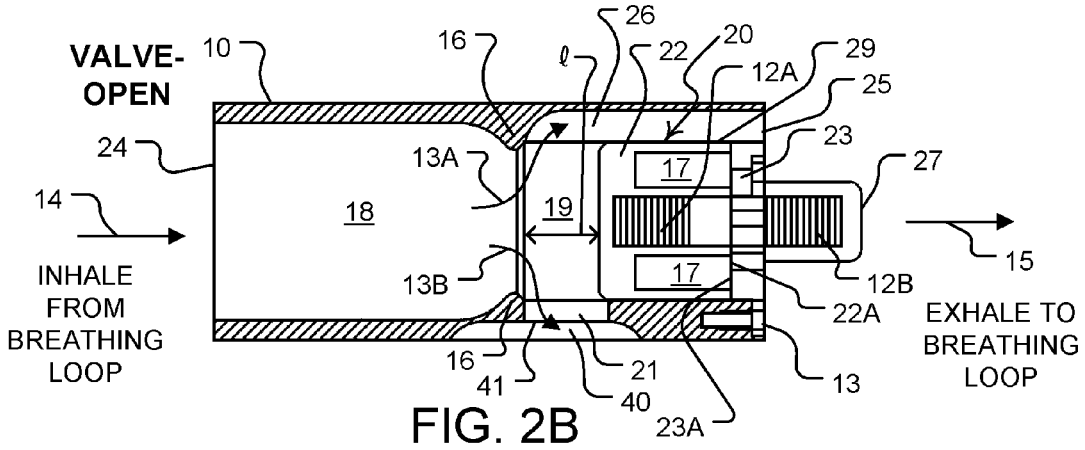

According to particular embodiments, the mouthpiece comprises an outer casing 30 (see FIGS. 1A through 1E), a sleeve 10 housed within casing 30 (see FIGS. 3A through 3F) and a valve assembly 20 housed within sleeve 10 (see FIGS. 2A and 2B). In the illustrated embodiment, as seen in FIGS. 1A through 1E, casing 30 is a generally tubular piece having longitudinally opposed first open end 34 ("inhale end") and second open end 35 ("exhale end").

In the illustrated embodiment, portions of casing 30 which are proximate to opposed ends 34, 35 comprise circumferential grooves 31 on the outer surface of casing 30 (see FIGS. 1A and 1B). Such grooves 31 may be shaped for receiving corresponding O-rings, deformable clips and/or the like to facilitate attachment of the mouthpiece to hose attachments and inhale and exhale hoses (not shown). Inhale end 34 is couplable by way of a hose attachment to an inhale hose for carrying air to be inhaled by the diver from an egress of a breathing loop (not shown) to the mouthpiece. Exhale end 35 is couplable by way of a hose attachment to an exhale hose for carrying the diver's exhaled air away from the mouthpiece and to an ingress of the breathing loop.

Grooves 31 shown in FIGS. 1A and 1B are not mandatory. In other embodiments, other suitable attachment mechanisms may be used to attach exhale and inhale hoses of the breathing loop to the mouthpiece. By way of non-limiting example, such attachment mechanisms may include one or more of the following: hose clamps, circlips, threaded attachments, circumferential ridges, and/or the like. In other embodiments, other forms of conduits may be used to connect mouthpiece exhale end 35 to the ingress of the breathing loop and mouthpiece inhale end 34 to the egress of the breathing loop.

A check valve (not shown), such as a mushroom valve, another type of one-way valve and/or the like, may be positioned between inhale end 34 and the inhale hose to ensure that air at inhale end 34 flows in a direction indicated generally by arrow 14 of FIG. 1E, and not in the reverse direction. Valve assembly 20 housed within sleeve 10 operates to ensure that air exiting the mouthpiece at exhale end 35 flows in a direction indicated generally by arrow 15 of FIG. 1E, and not in the reverse direction. In some embodiments, a second check valve (not shown), such as a mushroom valve, another type of one-way valve and/or the like, may be positioned between exhale end 35 and the exhale hose to ensure that air at exhale end 35 flows in the direction indicated generally by arrow 15.

As best seen in FIGS. 1A, 1B and 1D, casing 30 comprises a mouth port 32 through which the user (e.g. a diver) inhales and exhales. Port 32 of the illustrated embodiment comprises outwardly extending, curved cylindrical walls 32A for receiving a pliable (e.g. elastomeric) mouth bit (not shown) such as those used for mouthpieces for conventional scuba regulators and/or the like. The mouth bit typically has a U-shaped extension shaped to be received within the diver's mouth.

Casing 30 of the illustrated embodiment also comprises one or more discharge ports 36 through which air within the mouthpiece may be exhausted or discharged to the ambient environment. In some embodiments, there are a plurality (e.g. two) of discharge ports 36. Each discharge port 36 may have one or more apertures 36A. Each discharge port 36 includes a one-way valve assembly (not shown) which permits air from the mouthpiece to escape through apertures 36A to the surrounding environment, but does not permit fluid (e.g. water) from the surrounding environment to enter the mouthpiece.

By way of non-limiting example, the one-way valve assembly at discharge port 36 may comprise a flexible diaphragm or flap covering apertures 36A and a rigid (or semi-rigid) disc positioned over the diaphragm to hold the diaphragm in place. The diaphragm may be made of latex rubber and the disc may be made of Delrin™, for example. The diaphragm deforms or otherwise lifts away from apertures 36A to allow air to escape through apertures 36A when the air pressure in the mouthpiece is above a threshold level. The diaphragm returns to a closed position covering apertures 36A once the air pressure in the mouthpiece drops below the threshold level. One or more screws may be inserted through the diaphragm and disc to secure the diaphragm and disc to casing 30. Other fasteners may be used to secure the diaphragm and disc to casing 30. In other embodiments, other forms of one-way valves may be used in combination with discharge ports 36 to permit air to escape from the mouthpiece while preventing the ingress of fluid (e.g. water) from the surrounding environment.

As seen in FIGS. 1B and 1C, casing 30 has a circumferentially elongated slot 37. Slot 37 is shaped for receiving a selector knob 51 (FIGS. 3D and 3E) extending from and attached to a sleeve 10 housed within casing 30. The diver may move selector knob 51 within slot 37 to rotate sleeve 10 between an "ON" position in which all ports of the mouthpiece are opened (e.g. such that aperture 46 through sleeve 10 is aligned with mouth port 32, and each discharge slot 41 through sleeve 10 is aligned with a corresponding discharge port 36), and an "OFF" position in which all ports of the mouthpiece are closed (e.g. aperture 46 and discharge slots 41 through sleeve 10 are sealed from the ambient environment as they are misaligned with their corresponding ports 32, 36 in outer casing 30). Sleeve 10 may be rotated to the "ON" position when the mouthpiece is being used by the diver, and may be rotated to the "OFF" position when the mouthpiece is not being used by the diver.

Figure 3A:
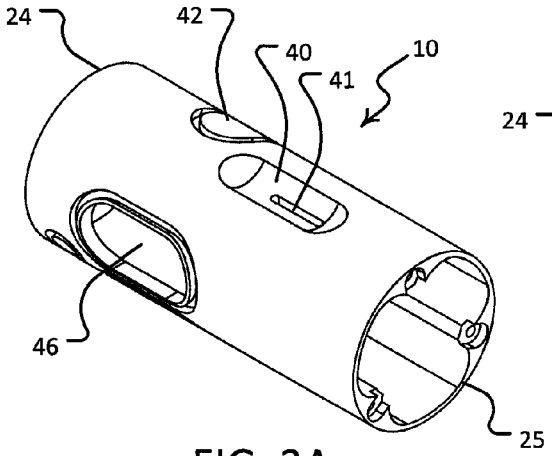
FIGS. 3A and 3B are isometric views of the sleeve shown in FIGS. 2A through 2D.
Figure 3B:
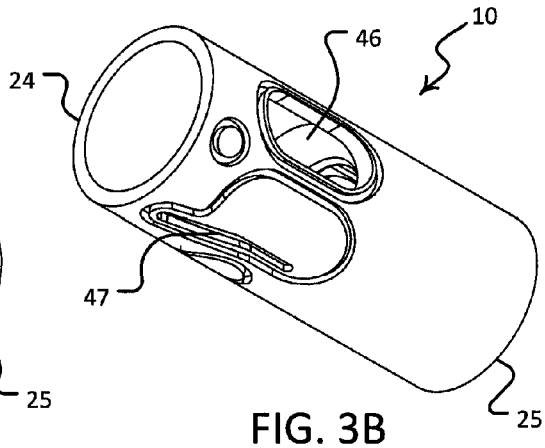
Figure 3C:
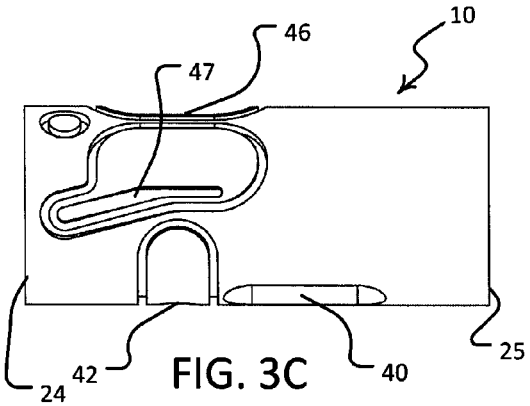
FIGS. 3C through 3E are side elevation views of the sleeve shown in FIGS. 2A through 2D.
Figure 3D:
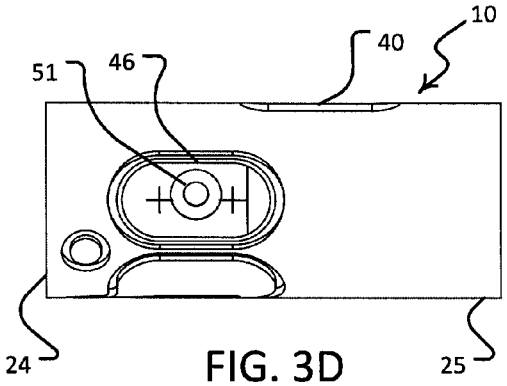

In the illustrated embodiment, as best seen in FIGS. 3A and 3B, sleeve 10 is a generally tubular piece having a first open end 24 ("inhale end") and a second open end 25 ("exhale end"). When sleeve 10 is inserted into casing 30, inhale end 24 of sleeve 10 is generally aligned with inhale end 34 of casing 30, and exhale end 25 of sleeve 10 is generally aligned with exhale end 35 of casing 30.

FIGS. 2A and 2B illustrate a valve assembly 20 that may be housed within sleeve 10. Sleeve 10 and valve assembly 20 together are housed within casing 30. In the illustrated embodiment, when valve assembly 20 is inserted into sleeve 10, valve assembly 20 may be located generally proximate to exhale end 25 of sleeve 10. An air space or chamber 18 is defined within sleeve 10 between inhale end 24 of sleeve 10 and valve assembly 20.

When the mouthpiece is in use (i.e. when selector knob 51 and sleeve 10 are rotated to the "ON" position), discharge ports 36 are aligned with corresponding discharge slots 41 in sleeve 10 (see FIGS. 2A, 2B, 2C and 3A). Mouth port 32 in casing 30 (FIG. 1A) is aligned with a corresponding aperture 46 in sleeve 10 (FIG. 3A). Mouth port 32 and aperture 46 are in fluid communication with air space 18 such that air exhaled by the diver into the mouthpiece (via mouth port 32) moves into air space 18 (FIGS. 2A and 2B). Conversely, air inhaled by the diver moves out of air space 18, through aperture 46 and mouth port 32, and into the diver's mouth. As explained below, the changes in air pressure in air space 18 resulting from the diver's breathing cause the components of valve assembly 20 to move, thereby controlling the discharge of exhaled air from the mouthpiece at exhale end 25 and at discharge ports 36 (via discharge slots 41 in sleeve 10).

Valve assembly 20 is operable to control the flow of air from air space 18 toward exhale end 25 and discharge slots 41. When valve assembly 20 is in the valve-closed position (e.g. see FIG. 2A), valve assembly 20 prevents air in air space 18 from travelling toward exhale end 25 and discharge slots 41. When valve assembly 20 is in a valve-open position (e.g. see FIG. 2B), valve assembly 20 permits air in air space 18 to travel toward exhale end 25 and discharge slots 41.

As shown in FIGS. 2A and 2B, valve assembly 20 comprises valve components 22, 23 which are moveable in relation to one another. Such valve components may comprise a moveable component 22 and a fixed component 23. Valve components 22, 23 may be generally cylindrical in shape. In the illustrated embodiment, moveable component 22 is supported for movement in longitudinal (e.g. axial) directions within a generally tubular inner sleeve wall 29. Inner sleeve wall 29 may be integrally formed with, or connected to, sleeve 10. Valve components 22, 23 may have generally parallel (or otherwise complementary-shaped), facing surfaces 22A, 23A, respectively.

In the illustrated embodiment, fixed component 23 is fixed in position relative to sleeve 10, and is positioned at or close to exhale end 25. A plurality of screws 13 or other fasteners may be used to secure fixed component 23 to the walls of sleeve 10 at or near exhale end 25. In other embodiments, fixed component 23 may be secured to sleeve 10 in some other manner (e.g. deformable connectors, clasps, suitable adhesives, welding and/or the like.). In still other embodiments, fixed component 23 may be integrally formed with sleeve 10.

In the illustrated embodiment, moveable component 22 is slidable between: (a) a valve-closed position in which moveable component 22 is separated from fixed component 23 at exhale end 25 by a maximum or valve closed distance $d_{max}$ (FIG. 2A), and (b) a valve-open position in which moveable component 22 has moved toward fixed component 23 and the distance between valve components 22, 23 is less than distance $d_{max}$. FIG. 2B shows valve assembly 20 in the maximum valve-open position in which moveable component 22 has moved toward fixed component 23 by a distance such that surface 22A of moveable component 22 abuts surface 23A of fixed component 23.

When moveable component 22 is in the valve-closed position (FIG. 2A), moveable component 22 is constrained from moving toward inhale end 24 by a stop 16. For example, stop 16 may comprise a ridge or other protrusion(s) extending from the inside surfaces of sleeve 10 for engaging with corresponding surfaces of moveable component 22. Stop 16 and the corresponding surfaces of moveable component 22 may be shaped to be complementary to one another (i.e. for generally airtight engagement) such that when moveable component 22 is in the valve-closed position, air in air space 18 is prevented from moving toward exhale end 25 and toward discharge slots 41 (see FIG. 2A). In the illustrated embodiment, when valve assembly 20 is in the valve-closed position, air in air space 18 is blocked from moving into air channels 21, 26 leading to discharge slots 41 and exhale end 25, respectively.

In the illustrated embodiment, valve components 22, 23 are biased apart—i.e. valve assembly 20 is biased to be in the valve-closed position shown in FIG. 2A in the absence of any counteracting forces. Valve components 22, 23 may be magnetically biased apart as described in further detail below. As the diver exhales into the mouthpiece, the air pressure in air space 18 initially increases since the exhaled air is trapped within air space 18. When the air pressure in air space 18 increases beyond a level sufficient to overcome the biasing forces that are holding valve components 22, 23 apart in the valve-closed position, moveable component 22 moves toward fixed component 23—i.e. valve assembly 20 is moved to a valve-open position. The movement of moveable component 22 toward fixed component 23 results in an increase in the size of air space 18 and a corresponding reduction in the air pressure in air space 18. The valve-open position represents an equilibrium between forces caused by the air pressure and the bias.

Movement of moveable component 22 toward fixed component 23 opens up a new air space 19 within sleeve 10 previously occupied by moveable component 22 (e.g. see FIG. 2B). This can also be described as an enlargement of air space 18 to include the air space previously occupied by moveable component 22. In the illustrated embodiment, air space 19 (or enlarged air space 18) is in fluid communication with one or more longitudinal (recirculation) air channels 26 extending longitudinally between air space 18 and exhale end 25. In the illustrated embodiment, air space 19 (or enlarged air space 18) is also in fluid communication with one or more discharge air channels 21. Each discharge air channel 21 may extend transversely to a corresponding discharge slot 41 at the outer surface or walls of sleeve 10. In the illustrated embodiment (see FIG. 2C), each discharge air channel 21 extends radially to a corresponding discharge slot 41. Openings may be defined in inner sleeve wall 29 to permit air to travel from air space 19 to channels 21 and 26.

As seen in FIG. 2B, during an exhale breath, moveable component 22 moves toward fixed component 23 by a distance which determines a length l of air channels 21, 26 that is exposed to air space 19. Length l varies according to the diver's breathing (e.g. a relatively strong exhale breath tends to cause moveable component 22 to move toward fixed component 23 by a greater distance, thereby causing a relatively long length l of exposed air channels 21, 26).

Once moveable component 22 has moved toward fixed component 23 (i.e. away from the valve-closed position and into a valve-open position), the diver's exhaled air which was previously trapped in air space 18 is able to move into new air space 19, and into air channels 21 and 26. As indicated in FIG. 2B, a portion of the air travelling through the mouthpiece may take the flow path indicated by arrow 13A, travelling through the one or more recirculation air channels 26 before exiting the mouthpiece at exhale end 25, after which it is recirculated through the breathing loop. Another portion of the air travelling through the mouthpiece may take the flow path indicated by arrow 13B, travelling through the one or more discharge air channels 21 before exiting the mouthpiece at discharge slot 41 (and discharge port 36). Air exiting through discharge slot 41 is exhausted to the ambient environment.

Figure 2C:
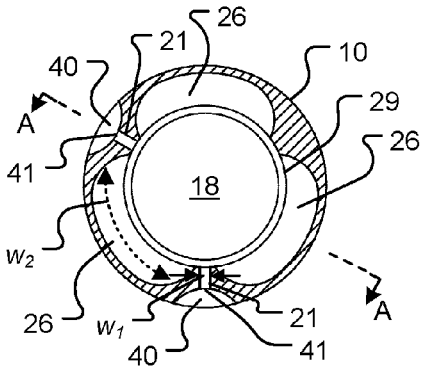
FIGS. 2C and 2D are end elevation views of the sleeve and valve assembly shown in FIGS. 2A and 2B.
Figure 2D:
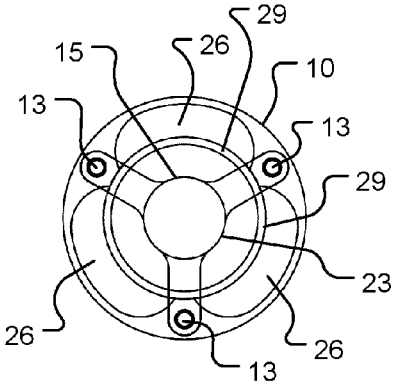

In the illustrated embodiment, as best seen in FIG. 2C, sleeve 10 has three recirculation air channels 26 each extending to exhale end 25, and two discharge air channels 21 each extending to a corresponding discharge slot 41. Each discharge slot 41 may be located in a corresponding recessed portion 40 of sleeve 10. Recessed portion 40 provides an air space between discharge slot 41 and the one-way valve assembly at discharge port 36 (see FIG. 1B).

In the illustrated embodiment, the three recirculation air channels 26 are evenly circumferentially spaced apart. Each of the two discharge air channels 21 extends transversely between two adjacent recirculation air channels 26. Other configurations and shapes of air channels 21, 26 are possible. For example, a different number and/or arrangement of air channels 21, 26 may be provided than as shown in the illustrated embodiment.

As seen in FIG. 2C, the circumferential width $w_1$ of each discharge air channel 21 is smaller than the circumferential width $w_2$ of each recirculation air channel 26. The relative proportion of air travelling through channels 21, 26 may be determined at least in part by the minimum cross-sectional areas in the flow paths between air spaces 18, 19 and channels 21, 26. In the illustrated embodiment these cross-sectional areas are defined at least approximately by the circumferential widths $w_1$, $w_2$ of air channels 21, 26 at the interface between air space 19 and air channels 21, 26, and a length l of air channels 21, 26 that is directly exposed to air space 19 (i.e. not covered by moveable component 22) as a result of movement of moveable component 22 toward fixed component 23 (see FIG. 2B).

In particular embodiments, the magnitude of the biasing forces acting on valve components 22, 23 is such that when a diver exhales into the mouthpiece under typical operating conditions (for example, use at a depth of up to 100 feet), moveable component 22 typically moves toward fixed component 23 by a distance which is between 30% to 80% of $d_{max}$. In such embodiments, during the exhale breath, moveable component 22 rarely moves completely to the maximum valve-open position in which moveable component 22 abuts fixed component 23, as seen in FIG. 2B.

A decrease in air pressure in air space 18 to a level such that the force on moveable component 22 is less than the current bias force may result in moveable component 22 moving back toward inhale end 24 until moveable component 22 reaches either a new equilibrium position or the valve-closed position shown in FIG. 2A. The air pressure in air space 18 may be decreased as a result of: moveable component 22 moving toward fixed component 23 (thereby resulting in a corresponding expansion to air space 18), the diver inhaling (thereby removing air from air space 18), the diver ceasing to exhale or decreasing the strength of the exhale breath and/or air exiting space 18 via air channels 21, 26.

In particular embodiments, valve components 22, 23 are magnetically biased apart—i.e. toward the valve-closed position shown in FIG. 2A. In the illustrated embodiment, a plurality of magnets 12A, 12B are embedded within valve components 22, 23, respectively (see FIGS. 2A and 2B). Due to space constraints within sleeve 10, fixed component 23 may include a cylindrical extension 27, which may extend into the exhale hose, for accommodating magnets 12B. Magnets 12A, 12B are arranged with their similar poles facing one another (i.e. magnets 12A are arranged so as to repel magnets 12B), resulting in biasing forces which keep valve components 22, 23 apart in the valve-closed position, in the absence of any counteracting forces.

The rate of air being exhaled by the diver (i.e. volume of exhaled air entering the mouthpiece per time unit) determines the pressure in air spaces 18, 19 and the corresponding distance by which moveable component 22 moves toward fixed component 23. For higher rates of exhaled air, moveable component 22 moves by a correspondingly larger distance toward fixed component 23, thereby increasing the exposed length l of air channels 21, 26 and allowing air in air spaces 18 and 19 to flow into channels 21, 26 at a higher rate. However, as the relative (i.e ratio of) minimum cross-sectional areas in the flow paths between air spaces 18, 19 and channels 21, 26 remains generally constant, the relative proportion of air travelling through channels 21, 26 also remains generally constant. Therefore, the proportion of the exhaled air that is exhausted to the ambient environment through discharge slots 41 relative to a total amount of exhaled air remains generally constant during operation.

For a given configuration of recirculation air channels 26 (e.g. number, volume and circumferential width $w_2$ of channels 26, etc.), a larger the number and/or circumferential width $w_1$ of discharge air channels 21, the greater the proportion of exhaled air that is exhausted to the ambient environment. In particular embodiments, the number and dimension(s) (e.g. circumferential width(s) $w_2$) of recirculation air channels 26) and the number and dimension(s) (e.g. circumferential width(s) $w_1$) of discharge air channels 21 are selected such that between approximately 20% to 30% of exhaled air is exhausted to the ambient environment through discharge air channels 21 and discharge slots 41, and the remainder (i.e. between approximately 70% to 80%) of the exhaled air travels through recirculation air channels 26 and exits the mouthpiece at exhale end 25, where it is recaptured for recirculation through the breathing loop.

A total amount of air that exhausted through both recirculation air channels 26 and discharge air channels 21 may be proportional to (or correlated with) the number of recirculation air channels 26 and discharge air channels 21 multiplied by their corresponding widths according to:

$$\text{total amount exhausted} \propto (\#\text{ of recirculation channels})\, w_2 + (\#\text{ of discharge channels})\, w_1$$

Accordingly, the proportion of air that is exhausted to the ambient environment through discharge air channels 21 relative to the amount of total amount of exhausted air through both discharge air channels 21 and recirculation air channels 26 may be proportional to (or correlated with) the ratio of the number of discharge air channels 21 multiplied by their corresponding widths divided by the total amount of exhausted air according to:

$$\text{proportion discharged}=(\#\text{ of discharge channels})w_1/(\#\text{ of recirculation channels})w_2+(\#\text{ of discharge channels})w_1$$

In some embodiments, various discharge air channels 21 and/or various recirculation air channels 26 may be provided with different widths, in which case the foregoing equations may be adjusted accordingly.

The number and dimension(s) (e.g. circumferential width(s) $w_2$) of recirculation air channels 26) and the number and dimension(s) (e.g. circumferential width(s) $w_1$) of discharge air channels 21 may vary between different embodiments rated for different skill levels, depths, dive duration, etc. For example, for recreational diving (e.g. at depths of up to 100 feet) it may be desirable to adjust one or more of these parameters such that approximately 30% of the exhaled air is exhausted to the ambient environment. For deeper or more technical diving, it may be desirable to adjust one or more of these parameters such that approximately 20% of the exhaled air is exhausted to the ambient environment. In particular embodiments, where there are two discharge air channels 21 and three recirculation air channels 26, the ratio between circumferential widths $w_1$ and $w_2$ may be less than 0.15. In certain embodiments such ratio may be less than 0.10 and above 0.05.

It may be desirable to configure valve assembly 20 such that the air pressure needed to overcome the biasing forces (and other forces such as friction) holding valve components 22, 23 apart in the valve-closed position is sufficiently low, so that during each typical exhale breath, moveable component 22 moves toward fixed component 23 (i.e. valve assembly 20 is moved to a valve-open position) thereby allowing exhaled air to exit at exhale end 25 and discharge ports 36. Otherwise, if valve assembly 20 were to remain in the valve-closed position during an exhale breath, the exhaled air would remain trapped within air space 18 and could be subsequently inhaled by the diver.

In the illustrated embodiment (see FIGS. 2A and 2B), hollow spaces 17 may be formed within moveable component 22 to reduce the component's weight. This in turn may reduce friction between the outer surfaces of moveable component 22 and inner sleeve wall 29 and may help to facilitate movement of moveable component 22 relative to fixed component 23.

Figure 3E:
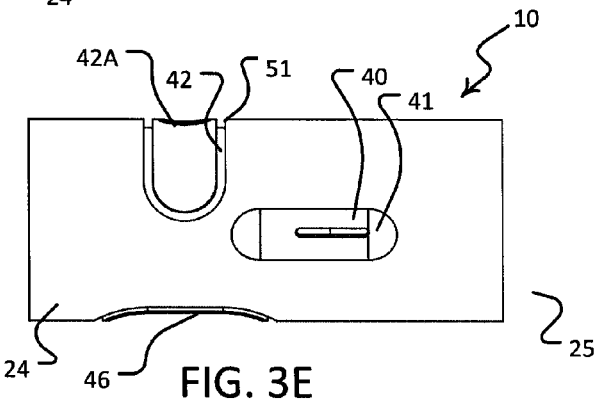
Figure 3F:
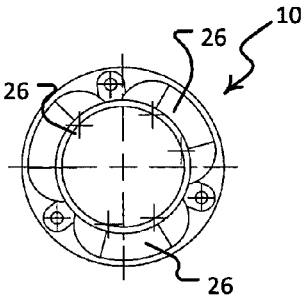
FIG. 3F is an end elevation view of the sleeve shown in FIGS. 2A through 2D.

As described above, by sliding selector knob 51 of sleeve 10 within slot 37 of casing 30, sleeve 10 may be rotated between an "ON" position in which all ports of the mouthpiece are opened, and an "OFF" position in which all ports of the mouthpiece are closed. As best seen in FIG. 3E, selector knob 51 may be surrounded by a groove 42A for receiving a suitably-shaped ring seal for preventing water from entering through slot 37 of casing 30.

Once the diver has rotated sleeve 10 to the "OFF" position, the diver may remove the mouth bit from his or her mouth. If the mouthpiece is kept immersed in water, the space circumscribed by the curved walls of mouth port 32 fills with water but the water is prevented from entering the mouthpiece given that openings into the mouthpiece (including aperture 46 and discharge slots 41) are sealed from the ambient environment in the "OFF" position. If the diver wishes to begin using the mouthpiece while the mouthpiece is immersed in water, the diver can blow into mouth port 32 while sleeve 10 remains in the "OFF" position. In such "OFF" position, mouth port 32 is aligned with slot 47 of sleeve 10 (see FIG. 3C) and slot 47 is in fluid communication with aperture 38 of casing 30 (see FIG. 1E). By blowing into mouth port 32, water which has been trapped within mouth port 32 can be expelled through slot 47 and aperture 38 into the ambient environment. A one-way valve may cover aperture 38 to prevent water from entering the mouthpiece through aperture 38. After the water has been cleared from mouth port 32 in this manner, the diver may rotate sleeve 10 to the "ON" position and the diver may begin exhaling and inhaling through mouth port 32 which is now aligned with aperture 46 of sleeve 10.

In some embodiments, one or more grooves may be provided in sleeve 10 at locations such that when sleeve 10 has been rotated to the "OFF" position, the grooves are aligned with discharge ports 36 of casing 30. Such grooves may receive corresponding ring seals (e.g. O-ring seals) for preventing gas from leaking through discharge ports 36 during positive pressure testing conducted on the mouthpiece when sleeve 10 has been rotated to the "OFF" position.

The illustrated embodiment contains a sleeve 10 within an outer casing 30. As described above, sleeve 10 may be rotated to switch the mouthpiece between "ON" and "OFF" positions. In other embodiments, sleeve 10 is omitted. In such embodiments, outer casing 30 is adapted to include the structural features of sleeve 10 which support the operation of valve assembly 20, such as, for example:

- inner walls 29 for supporting movement of moveable component 22 within a bore of casing 30;
- stop 16 for limiting the movement of moveable component 22 toward inhale end 24;
- one or more discharge air channels 21 extending transversely through casing 30 for carrying exhaled air toward discharge slot 41;
- one or more recirculation air channels 26 extending longitudinally through casing 30 for carrying exhaled air toward exhale end 25; and
- recessed portion 40 providing an air space between discharge slot 41 and the one-way valve assembly at discharge port 36;

as described above with reference to sleeve 10.

In the illustrated embodiment, two valve components 22, 23 are used. Magnets are housed within each of the valve components. In other embodiments, fixed component 23 is omitted, and magnets are disposed within or on portions of sleeve 10 (or casing 30) proximate to or at exhale end 25. Such magnets are arranged so as to repel the other magnets disposed within moveable component 22. In such embodiments, moveable component 22 is magnetically biased apart from the magnets positioned near exhale end 25.

The embodiments described herein are only examples. As will be apparent to those skilled in the art in the light of the foregoing disclosure, many alterations and modifications are possible in the practice of this invention without departing from the spirit or scope thereof. For example:

- A mouthpiece as described herein is not limited to use in underwater environments. The mouthpiece may be used for semi-closed circuit rebreather systems in other applications and environments where a gas is supplied for inhalation by the user, such as, for example, outer space, mining, mountaineering, submarines, and the like.
- The illustrated embodiment is generally tubular in shape. However, this is not mandatory. In other embodiments, the mouthpiece (including casing 30 and sleeve 10) may have a non-tubular or non-cylindrical shape (i.e. a shape having a non-circular cross-section). Moveable valve component 22 may be shaped and supported for movement within non-tubular or non-cylindrical walls.

Other biasing mechanisms may be used for valve assembly 20, such as, for example, spring or coil biasing mechanisms.

For bevity, this description and the accompanying claims refer to fluids exhaled into the mouthpiece, inhaled from the mouthpiece, discharging from the mouthpiece, ingressing into the breathing loop, egressing from the breathing loop and/or the like as "air". It will be understood by those skilled in the art that such fluids are not limited to "air" in the conventional sense and may include other fluids (e.g. gases and gases mixed liquids), mixtures of fluids and/or the like. It will be understood further that.

Other example embodiments may be obtained, without limitation, by combining features of the disclosed embodiments.

Accordingly, this invention should be interpreted in accordance with the following claims.

What is claimed is:

1. A mouthpiece for a rebreather having a breathing loop for treating exhaled breath and making the exhaled breath suitable for re-inhalation, the mouthpiece comprising:

a tubular housing comprising:

longitudinally opposed inhale and exhale ends, the inhale end in fluid communication with an egress of the breathing loop and the exhale end in fluid communication with an ingress of the breathing loop;

a mouth port through which a user inhales and exhales, the mouth port leading to a bore of the housing;

a discharge air channel having an opening into the bore, the discharge air channel extending transversely through a body of the housing and leading to a discharge port in fluid communication with an ambient environment;

a recirculation air channel having an opening into the bore, the recirculation air channel extending longitudinally through the body of the housing and leading to the exhale end; and a moveable valve component supported for movement in longitudinal directions within the bore and shaped to define a portion of an air space within the bore between the moveable valve component and the inhale end, the moveable valve component biased toward a valve-closed position wherein the moveable valve component is spaced apart from the exhale end by a valve closed distance $d_{max}$ and is located to block air flow into the openings of the discharge and recirculation air channels;

wherein an increase of air pressure in the air space tends to counteract the bias and move the moveable valve component toward a valve-open position wherein the distance between the moveable valve component and the exhale end is less than the valve closed distance $d_{max}$ and the openings of the discharge and recirculation air channels are exposed to permit air flow therethrough, wherein the increase in air pressure is caused by the user exhaling through the mouth port and thereby introducing air into the air space.

2. A mouthpiece according to claim 1 wherein the movement of the moveable valve component to the valve-open position causes an increase in the size of the air space and a corresponding reduction in air pressure, the valve-open position representing an equilibrium between forces caused by the air pressure and the bias.

3. A mouthpiece according to claim 1 wherein the moveable valve component is magnetically biased toward the valve-closed position.

4. A mouthpiece according to claim 1 comprising a first magnet disposed within the moveable valve component and a second magnet disposed at the exhale end, wherein the first and second magnets are arranged with like poles facing each other to magnetically bias the moveable valve component toward the valve-closed position.

5. A mouthpiece according to claim 4 comprising a fixed valve component proximate to the exhale end, wherein the second magnet is disposed within the fixed valve component.

6. A mouthpiece according to claim 4 wherein at least a portion of the second magnet is located outside of the bore of the housing.

7. A mouthpiece according to claim 1 wherein the discharge port comprises an aperture and a one-way valve assembly.

8. A mouthpiece according to claim 7 wherein the one-way valve assembly comprises a flexible diaphragm covering the aperture.

9. A mouthpiece according to claim 8 wherein the one-way valve assembly comprises a rigid disc positioned over the diaphragm.

10. A mouthpiece according to claim 1 wherein the housing comprises an outer tubular casing and an inner tubular sleeve disposed within the casing and rotatable about a longitudinal axis of the housing, wherein the bore is formed within the sleeve.

11. A mouthpiece according to claim 10 wherein the mouth port and the discharge port are formed in the casing, and the mouth port and the discharge port are alignable with corresponding openings in the sleeve.

12. A mouthpiece according to claim 11 wherein the sleeve comprises a selector knob extending through a corresponding selector aperture in the casing, the sleeve being rotatable about the longitudinal axis of the housing by movement of the selector knob within the selector aperture.

13. A mouthpiece according to claim 1 wherein there are three recirculation air channels, and two discharge air channels each leading to a corresponding discharge port in fluid communication with the ambient environment.

14. A mouthpiece for a rebreather having a breathing loop for treating exhaled breath and making the exhaled breath suitable for re-inhalation, the mouthpiece comprising:

a tubular housing comprising:

longitudinally opposed inhale and exhale ends, the inhale end in fluid communication with an egress of the breathing loop and the exhale end in fluid communication with an ingress of the breathing loop;

a mouth port through which a user inhales and exhales, the mouth port leading to a bore of the housing;

a discharge air channel having an opening into the bore, the discharge air channel extending transversely through a body of the housing and leading to a discharge port in fluid communication with an ambient environment;

a recirculation air channel having an opening into the bore, the recirculation air channel extending longitudinally through the body of the housing and leading to the exhale end; and a moveable valve component supported for movement in longitudinal directions within the bore and shaped to define a portion of an air space within the bore between the moveable valve component and the inhale end, the moveable valve component biased toward a valve-closed position wherein the moveable valve component is spaced apart from the exhale end by a valve closed distance $d_{max}$ and is located to block air flow into the openings of the discharge and recirculation air channels;

wherein an increase of air pressure in the air space tends to counteract the bias and move the moveable valve component toward a valve-open position wherein the distance between the moveable valve component and the exhale end is less than the valve closed distance $d_{max}$ and the openings of the discharge and recirculation air channels are exposed to permit air flow therethrough, wherein a distance by which the moveable valve component moves from the valve closed position toward the exhale end determines a length P of the openings of the discharge and recirculation air channels exposed to permit air flow therethrough.

15. A mouthpiece according to claim 14 wherein the discharge air channel has a first width $w_1$ and the recirculation air channel has a second width $w_2$ which is greater than the first width $w_1$.

16. A mouthpiece according to claim 15 wherein a ratio between the first and second widths is such that between approximately 20% to 30% of the exhaled air travels through the discharge air channel to the discharge port while the remainder of the exhaled air travels through the recirculation air channel to the exhale end.

17. A mouthpiece for a rebreather having a breathing loop for treating exhaled breath and making the exhaled breath suitable for re-inhalation, the mouthpiece comprising:

a housing comprising an inhale end in fluid communication with an egress of the breathing loop and an exhale end in fluid communication with an ingress of the breathing loop;

a valve located within the housing, the valve comprising a moveable valve component positionable between a valve-closed position wherein the valve confines air in an interior bore of the housing and a valve-open position wherein the valve permits air flow out of the bore through a recirculation air channel to the exhale end and through a discharge air channel to an ambient environment;

wherein the moveable valve component is magnetically biased toward the valve closed position;

wherein the housing is tubular, the bore is located on an interior of the tubular housing and inhale and exhale ends are located at longitudinally opposed ends of the tubular housing; and wherein the moveable valve component is shaped to occupy substantially an entirety of a cross-section of the bore.

18. A mouthpiece according to claim 17 comprising a first magnet disposed within the moveable valve component and a second magnet disposed at the exhale end, wherein the first and second magnets are arranged with like poles facing each other to magnetically bias the moveable valve component toward the valve-closed position.

19. A mouthpiece according to claim 18 comprising a fixed valve component proximate to the exhale end, wherein the second magnet is disposed within the fixed valve component.

20. A mouthpiece according to claim 18 wherein at least a portion of the second magnet is located outside of the bore of the housing.

21. A mouthpiece according to claim 17 wherein the housing comprises an outer tubular casing and an inner tubular sleeve disposed within the casing, the inner tubular sleeve rotatable about a longitudinal axis of the housing and the bore formed within the sleeve.

22. A mouthpiece according to claim 21 wherein the casing comprises a discharge port and a mouth port, wherein the mouth port and the discharge port are respectively alignable with a corresponding mouth opening and the discharge air channel through the sleeve.

23. A mouthpiece according to claim 22 wherein the sleeve comprises a selector knob extending through a corresponding selector aperture in the casing, the sleeve being rotatable about the longitudinal axis of the housing by movement of the selector knob within the selector aperture.

24. A mouthpiece for a rebreather having a breathing loop for treating exhaled breath and making the exhaled breath suitable for re-inhalation, the mouthpiece comprising:

a tubular housing comprising:

longitudinally opposed inhale and exhale ends at axial ends of the tubular housing, the inhale end in fluid communication with an egress of the breathing loop and the exhale end in fluid communication with an ingress of the breathing loop;

a mouth port located between the longitudinally opposed inhale and exhale ends through which a user inhales and exhales, the mouth port leading to a bore of the housing;

a discharge air channel having an opening into the bore, the discharge air channel leading to a discharge port in fluid communication with an ambient environment;

a recirculation air channel having an opening into the bore, the recirculation air channel leading to the exhale end; and a moveable valve component supported for movement in longitudinal directions within the bore and shaped to occupy substantially an entirety of a transverse cross-section of the bore and to thereby define a portion of an air space within the bore between the moveable valve component and the inhale end;

wherein the mouth port leads to the air space within the bore.

25. A mouthpiece according to claim 24 wherein the moveable valve component is positionable between a valve-closed position wherein the valve confines air in the air space and a valve-open position wherein the valve permits air flow out of the bore through the recirculation air channel to the exhale end and through the discharge air channel to the ambient environment.

26. A mouthpiece according to claim 25 wherein the moveable valve component is magnetically biased toward the valve closed position.

27. A mouthpiece according to claim 26 comprising a first magnet disposed within the moveable valve component and a second magnet disposed at the exhale end, wherein the first and second magnets are arranged with like poles facing each other to magnetically bias the moveable valve component toward the valve-closed position.

28. A mouthpiece according to claim 27 comprising a fixed valve component proximate to the exhale end, wherein the second magnet is disposed within the fixed valve component.

29. A mouthpiece according to claim 27 wherein at least a portion of the second magnet is located outside of the bore of the housing.

30. A mouthpiece according to claim 24 wherein the housing comprises an outer tubular casing and an inner tubular sleeve disposed within the casing, the inner tubular sleeve rotatable about a longitudinal axis of the housing and the bore formed within the sleeve.

31. A mouthpiece according to claim 30 wherein the discharge port and the mouth port are in the casing and are respectively alignable with a corresponding mouth opening and the discharge air channel through the sleeve.

32. A mouthpiece according to claim 31 wherein the sleeve comprises a selector knob extending through a corresponding selector aperture in the casing, the sleeve being rotatable about the longitudinal axis of the housing by movement of the selector knob within the selector aperture.

33. A method for controlling air flow in a rebreathing system comprising a mouthpiece and a rebreather having a breathing loop for treating exhaled breath and making the exhaled breath suitable for re-inhalation, the method comprising:

providing a housing comprising an inhale end in fluid communication with an egress of the breathing loop and an exhale end in fluid communication with an ingress of the breathing loop;

providing a valve located within the housing, the valve comprising a moveable valve component positionable between a valve-closed position wherein the valve confines air in an interior bore of the housing and a valve-open position wherein the valve permits air flow out of the bore through a recirculation air channel to the exhale end and through a discharge air channel to an ambient environment;

magnetically biasing the moveable valve component toward the valve closed position;

upon receiving an exhalation of breath into an air space located in the bore of the housing, permitting the moveable valve component to move from the valve-closed position to the valve-open position.

* * * * *